US005502855A

United States Patent [19]

Graebe

[11] Patent Number: 5,502,855

[45] Date of Patent: Apr. 2, 1996

[54] ZONED CELLULAR CUSHION

[76] Inventor: Robert H. Graebe, 7 Persimmon Ridge Dr., Belleville, Ill. 62223

[21] Appl. No.: 374,836

[22] Filed: Jan. 19, 1995

Related U.S. Application Data

[63] Continuation of Ser. No. 975,849, Nov. 13, 1992, abandoned, which is a continuation-in-part of Ser. No. 778,450, Oct. 16, 1991, Pat. No. 5,163,196, which is a continuation-in-part of Ser. No. 607,902, Nov. 1, 1990, abandoned.

[51] Int. Cl.[6] ..... A61G 9/00

[52] U.S. Cl. ..... 5/654; 5/455; 5/464

[58] Field of Search ..... 5/455, 456, 464, 5/449, 654, 653, 652; 297/DIG. 1, DIG. 3

[56] References Cited

U.S. PATENT DOCUMENTS

| | | | |
|---|---|---|---|
| 1,970,803 | 8/1934 | Johnson | 5/455 |
| 2,434,641 | 1/1948 | Burns . | |
| 2,575,764 | 11/1951 | Morner . | |
| 2,731,652 | 1/1956 | Bishop . | |
| 3,192,540 | 7/1965 | Swank | 5/456 |
| 3,192,541 | 7/1965 | Moore | 5/456 |
| 3,303,518 | 2/1967 | Ingram | 5/456 |
| 3,984,886 | 10/1976 | Keeton . | |
| 4,267,611 | 5/1981 | Agulnick . | |
| 4,541,136 | 9/1985 | Graebe . | |
| 4,662,012 | 5/1987 | Torbet | 5/455 |
| 4,698,864 | 10/1987 | Graebe . | |
| 4,864,671 | 9/1989 | Evans | 5/455 |

FOREIGN PATENT DOCUMENTS 1951476 10/1969 Germany .

OTHER PUBLICATIONS

Roho Inc. brochure; *The Challenge: Pelvic and Thigh Positioning,* date unknown.

Roho Inc. brochure; *The Roho Quadtro Cushion,* date unknown.

*Primary Examiner*—Flemming Saether

*Attorney, Agent, or Firm*—Polster, Lieder, Woodruff & Lucchesi

[57] ABSTRACT

An inflatable cushion having a series of separately inflatable zones with tubular conduits leading from each zone beneath or on top of the cushion within the periphery of the cushion to a common manifold spaced outwardly from the front edge of the cushion with a fill tube connected to the manifold and individual cut-off valves or a means to buckle the tubes for each conduit whereby the zones can be filled and bled simultaneously or selectively.

10 Claims, 2 Drawing Sheets

ZONED CELLULAR CUSHION

RELATED APPLICATIONS

This is a continuation application of application Ser. No. 07/975,849, filed on Nov. 13, 1992 (now abandoned) which is a continuation-in-part of Ser. No. 07/778,450 filed Oct. 16, 1991, (now U.S. Pat. No. 5,163,196) which is a continuation-in-part of Ser. No. 07/607,902, filed Nov. 1, 1990 (now abandoned).

BACKGROUND OF THE INVENTION

This invention relates in general to inflatable mattresses and cushions, and more particularly to an inflatable mattress or cushion having normally isolated zones and a series of valves for placing its normally isolated zones selectively in communication with each other and with atmosphere.

Those individuals who are confined to wheelchairs run the risk of tissue breakdown and the development of pressure sores, which are extremely dangerous and difficult to cure. Typically much of the individual's weight concentrates in the regions of the ischia, that is at the bony prominences of the buttocks, and unless frequent movement occurs, the flow of blood to the skin tissue in these regions decreases to the point that the tissue breaks down. Cushions which are especially designed for wheelchairs exist for reducing the concentration of weight in the region of the ischia, and these cushions generally seek to distribute the user's weight more uniformly over a larger area of the buttocks.

Cellular cushions provide the most uniform distribution of weight and thus provide the greatest protection from the occurrence of pressure sores. These cushions have an array of closely spaced air cells which project upwardly from a common base. Within the base the air cells communicate with each other, and thus all exist at the same internal pressure. Hence, each air cell exerts essentially the same restoring force against the buttocks, irrespective of the extent to which it is deflected. U.S. Pat. No. 4,541,136 shows a cellular cushion currently manufactured and sold by ROHO, Inc., of Belleville, Ill., for use on wheelchairs.

In a sense the typical cellular cushion provides a highly displaceable surface which tends to float the user. While this reduces the incidence of pressure sores, it detracts from the stability one usually associates with a seating surface. Most of those confined to wheelchairs have little trouble adjusting to the decrease in stability, but for those who have skeletal deformities, particularly in the region of the pelvis and thighs, and for those who lack adequate strength in their muscles, lesser stability can be a source of anxiety. A variation of the ROHO cellular cushion addresses this problem with totally isolated zones and also cells of varying height. By varying the pressure between zones, one can accommodate for skeletal deformities while still maintaining satisfactory protection against pressure sores. U.S. Pat. No. 4,698,864 shows a zoned cellular cushion with cells of varying height.

Typically, a zoned cellular cushion has a separate filling stem and valve for each of its zones. The user simply opens the valve of each stem and introduces air into the zone for that stem, usually with a hand pump, and then releases the air from the zones until the desired posture is achieved. In a more sophisticated arrangement, a hose kit connects a single pump to a manifold which in turn is connected to the several valves through separate hoses. These hoses are fitted with separate hose clamps so that the air from the pump may be directed to the cells of the individual zones independently, and likewise the air can be released from them independently, all by manipulating the clamps. The hoses of the hose kit lie externally of the cushion and may become entangled in components of a wheelchair. Furthermore, by reason of their remote location, the hose clamps are difficult to manipulate.

Even more traditional inflatable cushions derive advantages from zoning, that is from being divided into zones or compartments which can be isolated from each other to accommodate skeletal deformities.

Ser. No. 07/778,450 now U.S. Pat. No. 5,163,196, issued Nov. 17, 1992 describes a valve for a zoned inflatable cushion such that access to all of the zones is cut-off simultaneouly because the valve is in a flap which is part of the cushion base and all of the access channels run through the flap.

The present invention is an improvement on the prior cushions which utilize a series of hoses to inflate the cushion in that it positions the bodies of the hoses within the periphery of the cushion and gathers the ends of all of the hoses in close proximity adjacent to one edge so that they do not become entangled in the wheelchair and are readily accessible to the user. It also is an improvement on U.S. Pat. No. 5,163,196 in that the zones can be adjusted simultaneouly or selectively.

The present invention also resides in providing access to the cushion zones from beneath the cushion. A further advantage of the present invention is in providing access to the underside of the cushion and also to each cell of the cushion whereby pressure in each cell of the cushion can be monitored from a remote location.

This invention is equally appliable to inflatable mattresses, but will be described in connection with a wheelchair cushion.

These and other objects and advantages of the present invention will become apparent hereinafter.

DESCRIPTION OF THE DRAWINGS

In the accompanying drawings which form part of the specification and wherein like numerals and letters refer to like parts wherever they occur.

DETAILED DESCRIPTION

Figure 1:
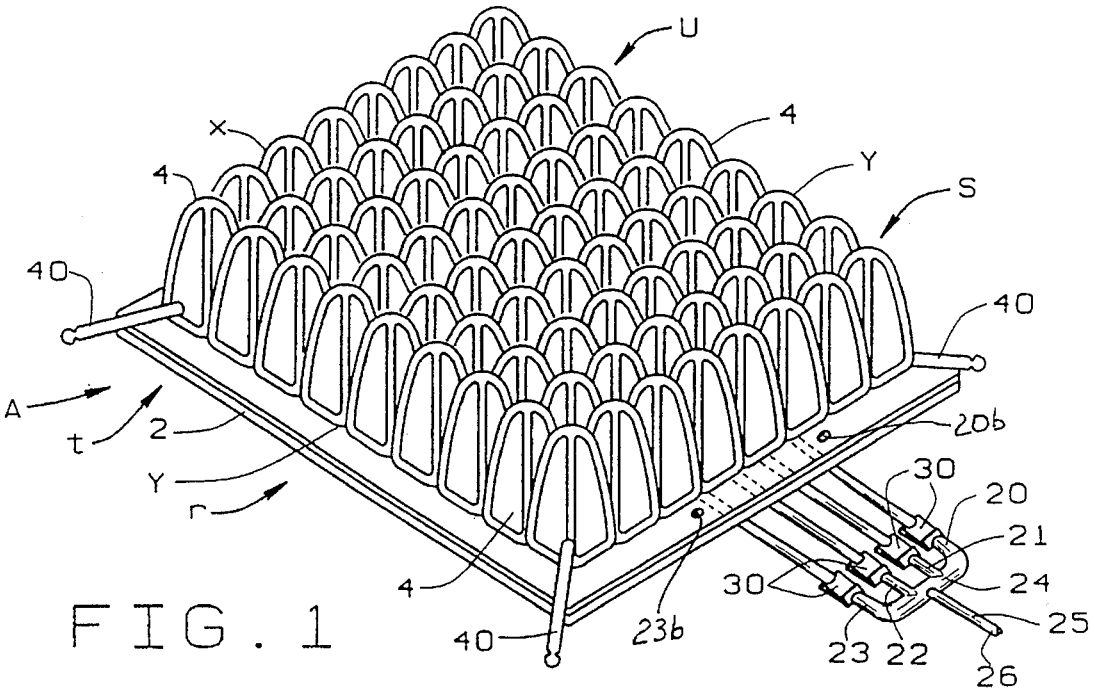
FIG. 1 is a top perspective view of a cushion embodying the invention.
Figure 2:
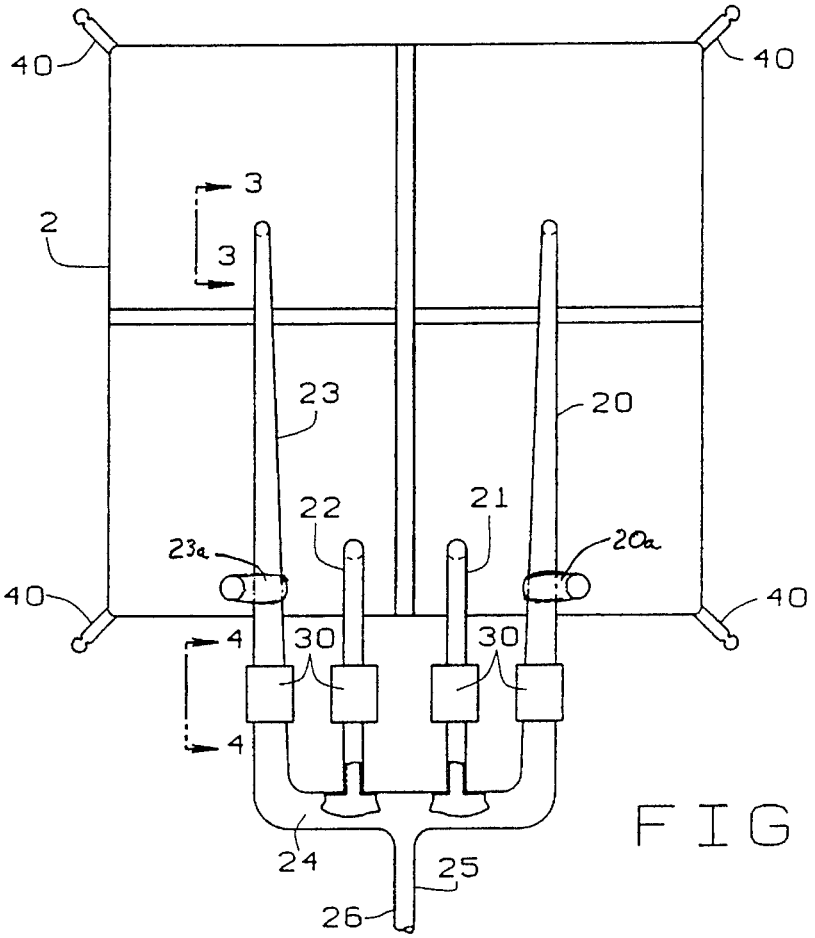
FIG. 2 is a bottom plan view of the cushion shown in FIG. 1.
Figure 3:
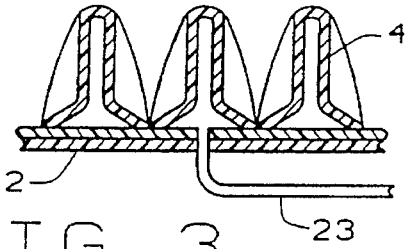
FIG. 3 is a fragmentary sectional view taken along lines 3—3 of FIG. 2.
Figure 4:
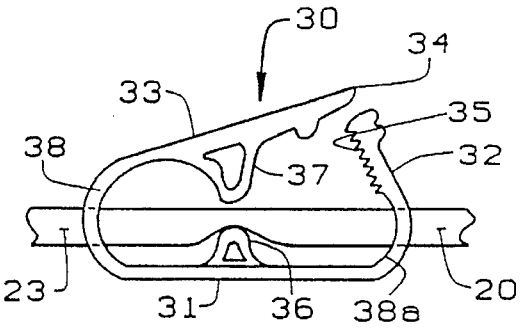
FIG. 4 is a fragmentary sectional view taken along lines 4—4 of FIG. 2.

Referring now to the drawings (FIG. 1), A designates a cellular cushion which is highly flexible and is designed for use on an underlying supporting surface, such as, the seat of a wheelchair or the seat of a conventional chair. Being cellular, the cushion A distributes the weight of its occupant generally uniformly over the entire area of the buttocks and thereby dissipates the pressures resulting from the supported weight at the ischia, that is, at the bony prominences of the buttocks. It further has the capacity to position and stabilize the user.

The cushion A includes (FIG. 1) a base 2 and air cells 4 which project upwardly from the base 2. Both the base 2 and the air cells 4 are preferably molded or otherwise formed from highly flexible neoprene. The base 2 is rectangular and the cells 4 are arranged on it in longitudinal rows and transverse rows, with each cell 4 occupying both a longitudinal row and a transverse row. The cells 4 are further arranged in zones, typically, four zones r, s, t, and u. The zones r and s lie side by side at the front of the cushion A, whereas the zones t and u exist side by side at the rear of the cushion A. The right zones r and t are separated from the left zones s and u along a longitudinal axis x—x, whereas the front zones r and s are separated from the rear zones t and u along a transverse axis y—y. More or less zones and differing arrangements of those zones may be employed.

Within the base 2, the cells 4 of the zone r communicate with each other, so that all exist at the same internal pressure irrespective of how far they are depressed. The same holds true with regard to the cells 4 of the zone s, the cells 4 of the zone t, and the cells 4 of the zone u. However, the cells 4 of the zone r normally do not communicate with the cells 4 of the zones s, t and u, or in other words the cells 4 of the zone r are normally isolated from the cells of the remaining zones s, t and u. Likewise the cells 4 of the zone s are normally isolated, as are the cells of the zones t and u. Thus, the cells 4 of each zone r, s, t and u collectively enclose a separate compartment.

Connected to each of the zones r, s, t and u are fill tubes 20, 21, 22 and 23, respectively. These are flexible and tubular in cross-section. These terminate in close proximity to each other adjacent to, but outwardly of one edge of the cushion A. Preferably they come out from beneath the front edge of the cushion A so they are accessible to the wheelchair user. The outermost fill tubes 20 and 23 are retained to the underside of the cushion A adjacent to the front edge by straps 20*a* and 23*a* which are secured to the cushion A, preferably by rivets 20*b* and 23*b*. The free ends of the tubes 20, 21, 22 and 23 are connected to a manifold 24 to which is connected a fill nozzle 25 having a shut off valve 26 (FIG. 1). The fill tubes 20, 21, 22 and 23 are all connected to the zones r, s, t and u through the underside of the cushion A. By passing beneath the cushion A, the fill tubes 20, 21, 22 and 23 provide access to the zones r, s, t and u for pressure monitoring devices. Also, there can be tubes or similar monitoring devices connected to each of the individual cells 4 through the underside of the cushion A so that a complete dynamic pressure profile of the patient can be taken at a remote location at any given point in time.

Positioned on each of the tubes 20, 21, 22 and 23 adjacent to the manifold 24 are cut-off clamp type hose valves 30. The valves 30, as shown, comprise a base 31 having an upstanding lock post 32. A spring arm 33 is connected to and overlies the base 31. The arm 32 has a knife edge nose 34 which is designed to engage notches 35 on the post 32 to lock the arm 33 to the post 35 when in cut-off position. Cut-off members 36 and 37 are on the base 31 and the arm 33 respectively. The cut-off members 36,37 are aligned, and when the nose 34 and lock notches 35 are engaged, move toward each other to force the tube sides together into linear sealing alignment to thereby block the tube and close off flow of air or other fluid through the fill tubes 20, 21, 22 and 23. The fill tubes 20, 21, 22 and 23 pass through the arm 33 and the lock post 32 by means of ports 38, 38*a*, respectively. These manually operated valves can be replaced with electrically operated solenoid valves which would permit sequential operation. If no valves are desired, then the air flow can be sealed off by folding the tubes 20, 21, 22 and 23 back on themselves to cause them to buckle as shown in FIG. 5.

Figure 5:
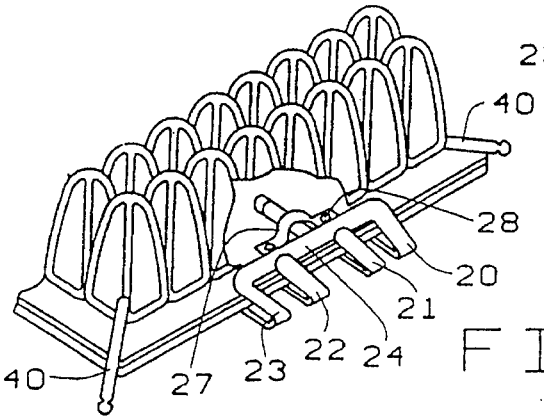
FIG. 5 is a fragmentary perspective view of a method of interrupting fluid flow through the manifold and the channels.

In the structure of FIG. 5, the flexible tubular channels 20, 21, 22, 23 and manifold 24 are bent back toward the cushion A to crimp the channels 20, 21, 22 and 23 and form linear seals therein. The manifold 24 is held in its bent back position by the combination of the rigid nozzle 25 and a flexible retaining strap 27 which has one end fixed to the base 2 and the other end has a suitable fastening means 28, such as a snap fastener or a hook and loop fastener sold under the trademark VELCRO. When using this type retainer, it is desirable to use individual fill tubes 40 for each of the zones to provide for selective individual adjustment of the zones.

OPERATION

In order to prepare the cushion A for the user, the valves 20, 21, 21 and 23 are opened. This places the interiors of the cells 4 for the four zones r, s, t and u in communication through the mainfold 24. Air is pumped into the cushion through the valve 26. Since the cells 4 of the zones r, s, t and u are in communication through the manifold 24, all of the cells 4 are inflated. The cells 4 reach a state of equilibrium in a short time. Enough air is pumped into the cushion A to exceed the requirements for supporting the user. The valve 26 is then closed and the pump removed.

Next the overinflated cushion A is placed on the supporting surface upon which it is to rest when supporting the user, and that could be a wheelchair seat or the seat of a traditional chair. The user then sits upon the cushion A in the location he expects to assume and slowly releases air from the filling valve 26 to immerse the user. As the air is released, the user's buttocks sink deeper and deeper into the array of air cells 4, and they tend to envelope and assume the contour of the buttocks. Enough air is released to bring the region of the ischia to within about ½ inch of the base 2. Of course, as the air flows out of the cushion A, all of the cells 4 remain at essentially the same internal pressure, because they are all interconnected through the open manifold 24. When the user achieves the desired immersion, the filling valve 26 is closed.

While immersed in the cells 4 of the cushion A, the user moves or is moved by others to the posture desired to be maintained for an extended period, and this causes a redistribution of air amongst the cells 4 of the several zones r, s, t and u. In time, the cells 4 of the several zones r, s, t and u reach equilibrium, that is to say the flow between the zones r, s, t and u ceases. At this time, the individual valves 20, 21, 22 and 23 are closed to prevent air from flowing between the zones r, s, t and u.

The isolated zones r, s, t and u impart stability to the cushion A, and this serves to maintain the user in the selected posture. Thus, if the user attempts to assume a different posture, he will encounter greater resistance from cells 4 of one of more of the zones r, s, t and u, and they will urge the user back to the initial posture. The capacity to maintain a selected posture or to urge the user to such a posture is particularly useful with users who suffer from spinal deformities and for those whose muscles have atrophied.

To further adjust the position of the user on the cushion, the valve 26 is opened and the individual cut-off valve 20, 21, 22 and 23 to the zone which is to be adjusted also is opened. Air can be added to or bled from the selected zone selectively without involving the other zones.

An alternative construction provides for individual fill valves 40 on each of the zones r, s, t and u. The valves 40 make it easier to test each quadrant or zone for leaks in the assembly process and also to separately fill or bleed each zone.

Thus, the sectors r, s, t, and u can be filled separately through the individual closure valves 40 or through selective opening and closing of the cut-off valves 20, 21, 22 and 23.

Figure 6:
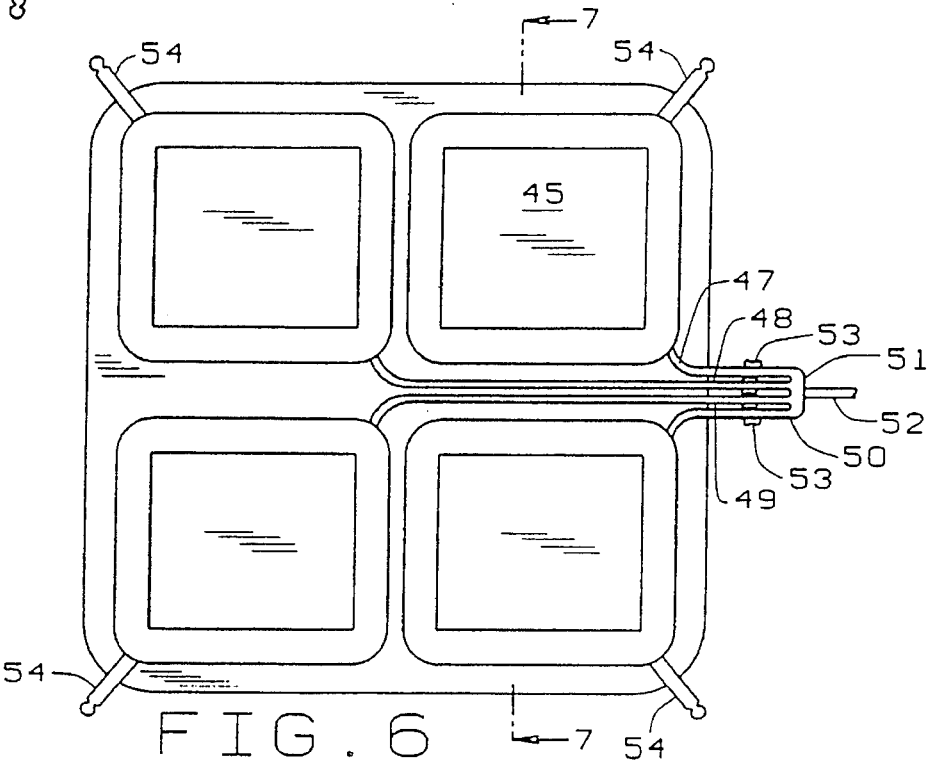
FIG. 6 is a top plan view of a modification of the invention.
Figure 7:
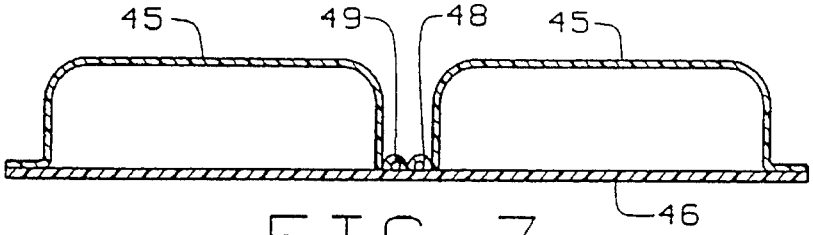
FIG. 7 is a sectional view taken along line 7—7 of FIG. 6.

FIGS. 6 and 7 show a modification of the invention in which four independent cells 45 are positioned on the base 46 and have individual fill channels 47, 48, 49 and 50 which are connected to a manifold 51 having a fill nozzle 52. The channels 47, 48, 49 and 50 may be on the top or the bottom of the base 46, but must be within the confines of the cushion and the ends should terminate in close proximity to each other outside one edge of the base 46.

Each of the channels 47, 48, 49 and 50 has a clamp or shut off valve 53 positioned between the edge of the cushion 46 and the manifold 51.

If clamps 53 are not used, the manifold 51 is bent back on itself and locked down to the base 46 to close off and seal the tubes 47, 48, 49 and 50 as shown in FIG. 5. If this variation is used, independent fill tubes 54 may be positioned in each of the cells 45 of the cushion.

This invention is intended to cover all changes and modifications of the example of the invention herein chosen for purposes of the disclosure which do not constitute departures from the spirit and scope of the invention.

What is claimed is:

1. A cellular cushion comprising a flexible non-rigid base throughout the cellular area of the cushion, said flexible base having front, rear and side edges, a plurality of flexible and hollow air containing cells attached to and projecting away from the flexible base, the cells being organized into zones, with the interiors of the cells for each zone within the region of the zone being in communication through the flexible base, but not with the air cells of the other zones, a manifold located at one edge of the flexible base and extending outwardly from the flexible base, first and second separate and independent air passages connected to each zone, said first air passage for each zone defining a fixed channel extending between at least one cell of its zone and the manifold, the channels being connected to the cushion cells through the flexible base of the cushion and the channels extending along the underside of the flexible base to the manifold, whereby the cells of the different zones communicate only through the manifold, and means for selectively blocking the channels independently of the manifold so that the cells of the different zones do not communicate and the air pressure of each zone can be adjusted independently, said second air passage for each zone being separate from and independent of the first air passage and the manifold to allow adding and bleeding air only from the zone to which it is connected.

2. The cushion of claim 1 wherein the channels are positioned within the periphery of the cushion until they come together to join the manifold.

3. The cushion of claim 1 wherein the channels are flexible and tubular in shape and the air blocking means are clamps which compress the flexible tubes together so that the interiors of the tube walls are flattened and form a linear seal across the tube.

4. A cellular cushion comprising a flexible non-rigid base throughout the cellular area of the cushion, said flexible base having front, rear and side edges, a plurality of flexible and hollow fluid containing cells attached to and projecting away from the flexible base, the cells being organized into zones, with the interiors of the cells for each zone within the region of the zone being in communication through the flexible base, but not with the air cells of the other zones, first and second separate and independent air passages connected to each zone, said first air passage for each zone defining a fixed channel extending from the bottom of at least one cell of its zone along the underside of the cushion and past an edge of the cushion, the channels having free ends which are connected to a manifold positioned past the cushion edge and the channels are flexible and tubular in shape, whereby the cells of the different zones do not communicate with each other and access to the individual cells is had to monitor the fluid pressure in the zones remotely from the cells, said second air passage for each zone being separate from and independent of the first air passage and the manifold to allow adding and bleeding air only from the zone to which it is connected.

5. The cushion of claim 4 including means for retaining the tubular members in juxtaposed position folded back upon themselves to shut off flow through all of the channels simultaneously.

6. The cushion of claim 4 wherein the channels include means for blocking the channels selectively and in unison.

7. The cushion of claim 4 wherein the portions of the channels which extend past the cushion edges are tubular and flexible and including means for squeezing the tube walls together into linear engagement to seal the tubes and stop fluid flow therethrough.

8. The cushion of claim 4 herein the channels which extend past the cushion edges are in close juxtaposition and are flexible and tubular and including means for squeezing the tube walls together into linear engagement to seal the tubes and stop fluid flow therethrough.

9. A cellular cushion comprising a flexible non-rigid base throughout the cellular area of the cushion, said flexible base having front, rear and side edges, a plurality of flexible and hollow fluid containing cells attached to and projecting away from the flexible base, first and second separate and independent air passages connected to each cell, said first air passage for each cell defining a fixed separate fill channel for each cell, with each channel extending from the underside of the cell along the flexible cushion base past an edge of the cushion, the channels having free ends which are connected to a manifold positioned past the cushion edge and the channels are flexible and tubular in shape, whereby the cells are independent and do not communicate with each other and access to the individual cells is had to change the fluid pressure in the cells remotely from the cells, said second air passage for each cell being separate from and independent of the first air passage and the manifold to allow adding and bleeding air only from the cell to which it is connected.

10. The cushion of claim 9 including means for retaining the tubular members in juxtaposed position folded back upon themselves to shut off flow through all of the channels simultaneouly.

* * * * *